US010251798B2

(12) United States Patent
Bednarz, III et al.

(10) Patent No.: US 10,251,798 B2
(45) Date of Patent: Apr. 9, 2019

(54) PRESSURE REDISTRIBUTION SYSTEM AND METHODS OF USING SAME

(71) Applicants: Edward T. Bednarz, III, Jessup, PA (US); Heather T. Bednarz, Jessup, PA (US); Matthew T. Aguilar, Stewartstown, PA (US); Robert W. Moyer, Jr., Coopersburg, PA (US); Amal Pillai, Kingston, PA (US); Jason E. Ugwu, Allentown, PA (US); Autumn L. Werner, Moosic, PA (US)

(72) Inventors: Edward T. Bednarz, III, Jessup, PA (US); Heather T. Bednarz, Jessup, PA (US); Matthew T. Aguilar, Stewartstown, PA (US); Robert W. Moyer, Jr., Coopersburg, PA (US); Amal Pillai, Kingston, PA (US); Jason E. Ugwu, Allentown, PA (US); Autumn L. Werner, Moosic, PA (US)

( * ) Notice: Subject to any disclaimer, the term of this patent is extended or adjusted under 35 U.S.C. 154(b) by 97 days.

(21) Appl. No.: 15/582,624

(22) Filed: Apr. 29, 2017

(65) Prior Publication Data

US 2018/0311095 A1 Nov. 1, 2018

(51) Int. Cl.
*A61G 7/057* (2006.01)
*A61G 5/10* (2006.01)

(52) U.S. Cl.
CPC ..... *A61G 7/05776* (2013.01); *A61G 5/1045* (2016.11); *A61G 5/1048* (2016.11);
(Continued)

(58) Field of Classification Search
CPC . A61G 7/05776; A61G 5/1048; A61G 5/1045
(Continued)

(56) References Cited

U.S. PATENT DOCUMENTS 5,637,076 A * 6/1997 Hazard ..... A61H 1/0292 297/284.6
5,687,438 A * 11/1997 Biggie ..... A61G 5/1043 297/284.6

(Continued)

*Primary Examiner* — Anthony D Barfield
(74) *Attorney, Agent, or Firm* — James R. McDaniel; Lawrence P. Zale; Zale Patent Law, Inc.

(57) ABSTRACT

A pressure redistribution system, including: a chair having a frame; a back cushion inflation system operatively connected to an upper portion of the frame, wherein the back cushion inflation system includes a back cushion and a plurality of back cushion air bladders located within an opening in the back cushion; a pump system operatively connected to the back cushion inflation system for inflating and deflating the back cushion air bladders; a seat cushion sensor system operatively attached to the wheelchair frame and the pump system, wherein the seat cushion sensor system includes a seat cushion and a plurality of seat cushion air bladders located within an opening in the seat cushion and a plurality of load sensors located adjacent to the plurality of seat cushion air bladders and wherein the pump system is able to inflate and deflate the plurality of seat cushion air bladders; a light display operatively connected to the back cushion inflation system, wherein the light display provides a visual indication as to a pressure being experienced by each of the plurality of load sensors; and a microcontroller located adjacent to the pump system, the seat cushion sensor system and the light display to assist in a determination of the pressure being experienced by each of the plurality of load sensors and to assist in providing the visual indication as to a pressure being experienced by each of the plurality of load sensors.

20 Claims, 7 Drawing Sheets

(52) U.S. Cl.
CPC ..... *A61G 2203/20* (2013.01); *A61G 2203/32* (2013.01); *A61G 2203/34* (2013.01)

(58) Field of Classification Search
USPC ..... 297/452.41, 284.6
See application file for complete search history.

(56) References Cited

U.S. PATENT DOCUMENTS

| | | | | |
|---|---|---|---|---|
| 6,030,351 | A | 2/2000 | Schmidt et al. | |
| 6,036,271 | A | 3/2000 | Wilkinson et al. | |
| 6,203,105 | B1 * | 3/2001 | Rhodes, Jr. ..... | A47C 4/54 297/284.6 |
| 6,299,250 | B1 * | 10/2001 | Orizaris ..... | B60N 2/0228 297/284.6 |
| 6,560,803 | B2 | 3/2003 | Zur | |
| 7,461,897 | B2 | 12/2008 | Kruse et al. | |
| 7,996,940 | B1 | 8/2011 | Dahm et al. | |

* cited by examiner

PRESSURE REDISTRIBUTION SYSTEM AND METHODS OF USING SAME

FIELD OF THE INVENTION

The present invention is generally related to a pressure redistribution system and methods of using the same. The pressure redistribution system uses load cells to read areas of pressure and microcontrollers to measure the time of pressure to determine when is too long or too much for the pressure. The system is able to alert an administrator/caregiver through the use of a light display when the pressure is too long or too much and to interact with a pump system connected to air bladders to inflate or deflate accordingly in order to shift the patient into opposite areas of pressure, therefore ensuring the patient is relieved of high pressure areas.

BACKGROUND OF THE INVENTION

It is well known that without the help of an administrator or caregiver, disabled people who are unable to reposition him or herself, due to their disability, do not get the proper routine movement required to prevent pressure ulcers. Often times, due to the number of patients assigned to occupational therapists, nurses, or caregivers, these administrators are unable to provide ideal movement to some patients. Moving patients can also take a toll on a caregiver's health and body. Therefore, it would be desired to develop a system that could notify a caregiver when someone has been sedentary for too long and develop a way of moving the sedentary individual automatically if the caregiver could not attend to them in time.

It is also well known that over 250,000 Americans have spinal cord injuries with 52% of spinal cord injury victims considered paraplegic and 47% quadriplegic. Most paraplegics live normal lives after their accident, but some admit that it is difficult at times. After a life-changing injury such as paralysis, most patients are confined to a wheelchair for the rest of their lives. Prolonged sitting and lack of change in posture or position of sitting can cause welts or pressure ulcers to be generated on an individual's body. Therefore, it would be further desired to develop a system that notifies a caregiver when someone has not moved for a while as well as moving them autonomously. In particular, it would be desired to be able to time a patient's movement and display the location where the most force is applied for that time period. In this manner, the information could then be used to move the patient as needed in order to distribute the force evenly and combat the development of pressure ulcers.

It is also well known that often times, when people study what ailments plague the elderly, they immediately think of Alzheimer's disease, cancer, stroke, and/or diabetes. These are all extremely serious ailments that greatly decrease the quality of life and often cause death. Some of these illnesses have been studied for decades and still are not fully understood, let alone made preventable. However, there is a condition that affects 2.5 million people in the United States each year and results in 60,000 annual fatalities. Unlike the other conditions, this disease is 100% preventable, and is known as a pressure ulcer.

It is important to note that pressure ulcers do not occur independently of other illnesses. They are most often the result of other disease processes that result in immobility such as Alzheimer's, paralysis, etc. They will continually reoccur even if treated, because of other diseases preventing the removal of the source of the pressure ulcer (i.e., we are treating a symptom but the disease that caused it remains unchanged). Pressure ulcers are known to be fatal in 60% of the elderly within one (1) year of hospital discharge (www.nih.gov).

Pressure ulcers have four stages with each stage being more severe than the previous stage. The first stage is redness and irritation on the surface of the skin. The second stage forms a small crater in the skin and appears to look like a blister on the skin. This stage is more painful than the previous stage but can still be easily treated. The third stage pierces the tissue of the skin which makes it more painful and takes much longer to heal. This stage also needs to be monitored more closely in order to prevent it from progressing into a more severe wound. The fourth and final stage often times results in fatality. It penetrates through the muscle and causes an open wound all the way to the bone, which makes it difficult to treat and extremely painful. It is to be understood that, at times, doctors may deem a pressure ulcer "unstageable" due to a decreased ability to visualize the depth of the pressure ulcer.

The areas most affected by pressure ulcers are those that have continuous contact with a surface. One way to prevent pressure ulcers is by shifting areas and amounts of pressure at least once every hour. Most people do this naturally as the body receives signals from nerve endings in the form of discomfort. It is known that people who are most at risk for pressure ulcers are those unable to shift themselves whether it be due to frailty, lack of strength, or a debilitating illness. As a result, a caregiver is often the best solution to ensure that those at risk get the proper movement in order to prevent these ulcers. Unfortunately, it is not always practical to expect a person to provide constant care to another.

It is even further known that prior to the present invention, as set forth in general terms above and more specifically below, to employ various types of pressure relief seating systems. See for example, U.S. Pat. No. 6,030,351 by Schmidt et al., U.S. Pat. No. 6,036,271 by Wilkinson et al., U.S. Pat. No. 6,560,803 by Zur, U.S. Pat. No. 7,461,897 by Kruse et al., and U.S. Pat. No. 7,996,940 by Dahm et al. While these various pressure relief systems may have been generally satisfactory, there is nevertheless a need for a new and improved pressure distribution system that is designed to use load cells to read areas of pressure and microcontrollers to measure the time of pressure to determine when is too long or too much for the pressure such that the system is able to alert a pump system connected to airbladders to inflate or deflate accordingly in order to shift into opposite areas of pressure, therefore ensuring the patient is relieved in the high pressure areas.

It is a purpose of this invention to fulfill these and other needs in the pressure distribution art in a manner more apparent to the skilled artisan once given the following disclosure.

BRIEF SUMMARY OF THE INVENTION

A first aspect of the present invention is a pressure redistribution system, including: a chair having a frame; a back cushion inflation system operatively connected to an upper portion of the frame, wherein the back cushion inflation system includes a back cushion and a plurality of back cushion air bladders located within an opening in the back cushion; a pump system operatively connected to the back cushion inflation system for inflating and deflating the back cushion air bladders; a seat cushion sensor system operatively attached to the wheelchair frame and the pump system, wherein the seat cushion sensor system includes a seat cushion and a plurality of seat cushion air bladders located within an opening in the seat cushion and a plurality of load sensors located adjacent to the plurality of seat cushion air bladders and wherein the pump system is able to inflate and deflate the plurality of seat cushion air bladders; a light display operatively connected to the back cushion inflation system, wherein the light display provides a visual indication as to a pressure being experienced by each of the plurality of load sensors; and a microcontroller located adjacent to the pump system, the seat cushion sensor system and the light display to assist in a determination of the pressure being experienced by each of the plurality of load sensors and to assist in providing the visual indication as to a pressure being experienced by each of the plurality of load sensors.

In one embodiment of the first aspect of the present invention, the back cushion inflation system further includes a back cushion frame having a first side and a second side such that the back cushion is operatively connected to the first side of the back cushion frame, and the pump system and the light display are operatively connected to the second side of the back cushion frame.

In another embodiment of the first aspect of the present invention, the back cushion air bladders include a back cushion air bladder connector that operatively connects each of the back cushion air bladders to the pump system.

In another embodiment of the first aspect of the present invention, the pump system includes an air compressor, a plurality of valves operatively connected to the air compressor, and a plurality of air pressure sensors operatively connected to the plurality of valves and the microcontroller.

In another embodiment of the first aspect of the present invention, the seat cushion sensor system includes an upper seat sensor frame having a first side and a second side such that the seat cushion is operatively attached to the first side of the upper seat sensor frame, and a lower sensor frame, wherein the plurality of load sensors is located between the second side of the upper seat cushion frame and the lower seat cushion frame.

In still another embodiment of the first aspect of the present invention, each of the seat cushion air bladders includes a seat cushion air bladder connector that operatively connects each of the seat cushion air bladders to the pump system.

In an even further embodiment of the first aspect of the present invention, the light display includes a light display panel operatively connected to the back cushion inflation system, and a plurality of lights operatively connected to the light display panel, wherein the plurality of lights is used to provide the visual indication as to a pressure being experienced by each of the plurality of load sensors.

In yet another embodiment of the first aspect of the present invention, the plurality of lights includes a plurality of green lights, a plurality of yellow lights, and a plurality of red lights.

A second aspect of the present invention is a chair having a pressure redistribution system, including: a chair having a frame; a back cushion inflation system operatively connected to an upper portion of the frame, wherein the back cushion inflation system includes a back cushion and a plurality of back cushion air bladders located within an opening in the back cushion; a pump system operatively connected to the back cushion inflation system for inflating and deflating the back cushion air bladders; a seat cushion sensor system operatively attached to the wheelchair frame and the pump system, wherein the seat cushion sensor system includes a seat cushion and a plurality of seat cushion air bladders located within an opening in the seat cushion and a plurality of load sensors located adjacent to the plurality of seat cushion air bladders and wherein the pump system is able to inflate and deflate the plurality of seat cushion air bladders; a light display operatively connected to the back cushion inflation system, wherein the light display provides a visual indication as to a pressure being experienced by each of the plurality of load sensors; and a microcontroller located adjacent to the pump system, the seat cushion sensor system and the light display to assist in a determination of the pressure being experienced by each of the plurality of load sensors and to assist in providing the visual indication as to a pressure being experienced by each of the plurality of load sensors.

In one embodiment of the second aspect of the present invention, the back cushion inflation system further includes a back cushion frame having a first side and a second side such that the back cushion is operatively connected to the first side of the back cushion frame, and the pump system and the light display are operatively connected to the second side of the back cushion frame.

In another embodiment of the second aspect of the present invention, the back cushion air bladders include a back cushion air bladder connector that operatively connects each of the back cushion air bladders to the pump system.

In another embodiment of the second aspect of the present invention, the pump system includes an air compressor, a plurality of valves operatively connected to the air compressor, and a plurality of air pressure sensors operatively connected to the plurality of valves and the microcontroller.

In another embodiment of the second aspect of the present invention, the seat cushion sensor system includes an upper seat sensor frame having a first side and a second side such that the seat cushion is operatively attached to the first side of the upper seat sensor frame, and a lower sensor frame, wherein the plurality of load sensors is located between the second side of the upper seat cushion frame and the lower seat cushion frame.

In still another embodiment of the second aspect of the present invention, each of the seat cushion air bladders includes a seat cushion air bladder connector that operatively connects each of the seat cushion air bladders to the pump system.

In an even further embodiment of the second aspect of the present invention, the light display includes a light display panel operatively connected to the back cushion inflation system, and a plurality of lights operatively connected to the light display panel, wherein the plurality of lights is used to provide the visual indication as to a pressure being experienced by each of the plurality of load sensors.

In yet another embodiment of the second aspect of the present invention, the plurality of lights includes a plurality of green lights, a plurality of yellow lights, and a plurality of red lights.

A third aspect of the present invention is a method of providing a chair with a pressure redistribution system, including the steps of: providing a chair having a frame; providing a back cushion inflation system, wherein the back cushion inflation system is operatively connected to an upper portion of the frame, wherein the back cushion inflation system includes a back cushion and a plurality of back cushion air bladders located within an opening in the back cushion; providing a pump system, wherein the pump system is operatively connected to the back cushion inflation system for inflating and deflating the back cushion air bladders; providing a seat cushion sensor system, wherein the seat cushion sensor system is operatively attached to the wheelchair frame and the pump system, wherein the seat cushion sensor system includes a seat cushion and a plurality of seat cushion air bladders located within an opening in the seat cushion and a plurality of load sensors located adjacent to the plurality of seat cushion air bladders and wherein the pump system is able to inflate and deflate the plurality of seat cushion air bladders; providing a light display, wherein the light display is operatively connected to the back cushion inflation system, wherein the light display provides a visual indication as to a pressure being experienced by each of the plurality of load sensors; and providing a microcontroller, wherein the microcontroller is located adjacent to the pump system, the seat cushion sensor system and the light display to assist in a determination of the pressure being experienced by each of the plurality of load sensors and to assist in providing the visual indication as to a pressure being experienced by each of the plurality of load sensors.

In one embodiment of the third aspect of the present invention, the method further includes the step of using the load sensors and the microcontroller to determine if a patient has been seated in a particular seated position for a pre-determined period of time.

In another embodiment of the third aspect of the present invention, the method further includes the step of providing the light display with a plurality of lights, wherein the plurality of lights is used to provide the visual indication as to how long the patient has been seated in the particular seated position and if the patient has been seated in the particular seated position for the pre-determined period of time.

In yet another embodiment of the third aspect of the present invention, the method further includes the step of adjusting an air pressure in the back cushion air bladders and/or the seat cushion air bladders after the pre-determined period of time has been reached.

The preferred pressure redistribution system, according to various embodiments of the present invention, offers the following advantages: ease of use; lightness in weight; durability; excellent pressure relief characteristics; automatic pressure relief; reduced likelihood of development of pressure ulcers; quietness of operation; ease of measurement of load pressures; use of a visual indication of an undesirable pressure load; and ease of application to a chair or wheelchair. In fact, in many of the preferred embodiments, these advantages are optimized to an extent that is considerably higher than heretofore achieved in prior known pressure redistribution systems.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

Figure 1:
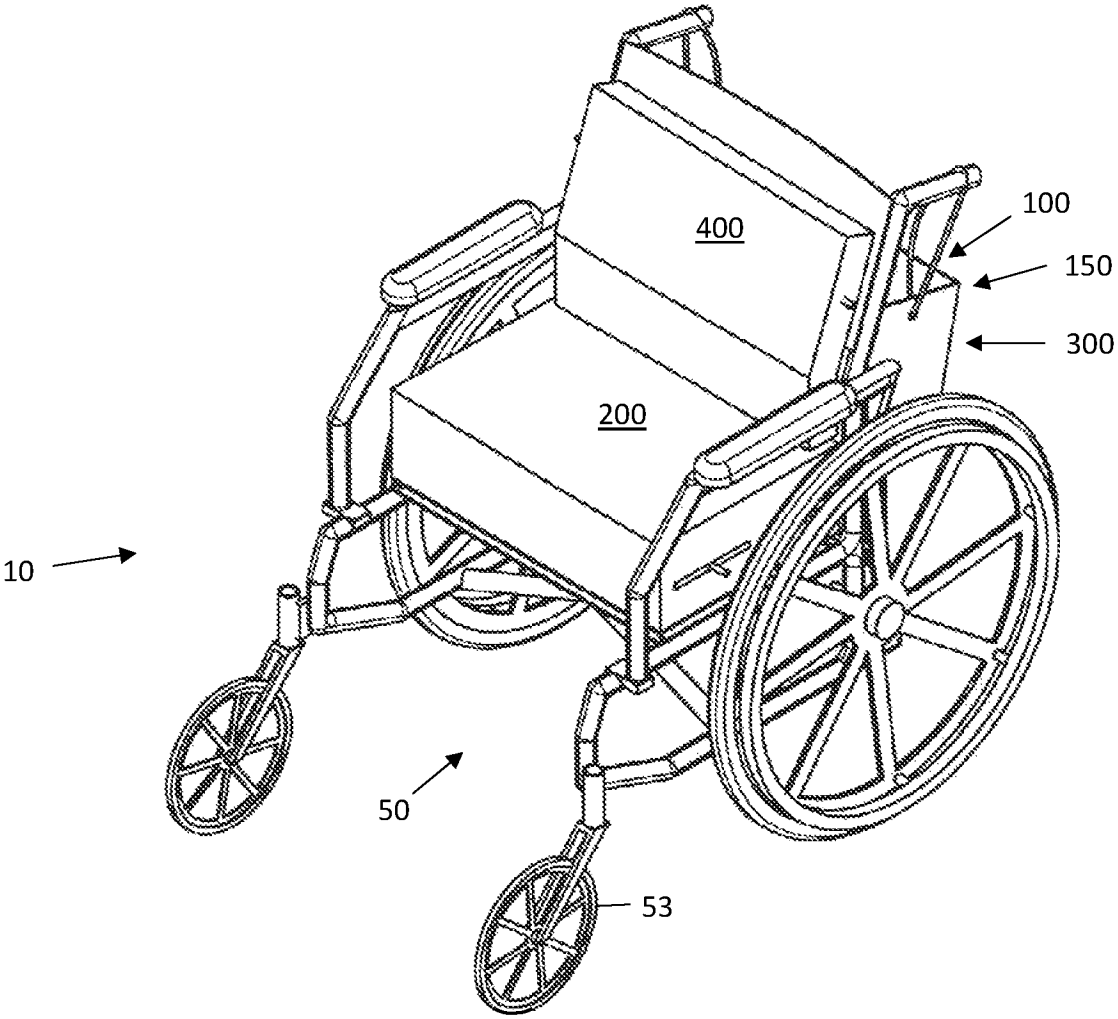
FIG. 1 is a front, isometric illustration of a pressure redistribution system for use with a wheelchair, constructed according to the present invention.

Referring now to FIG. 1, there is illustrated a pressure redistribution system 10. As will be explained hereinafter in greater detail, the pressure redistribution system 10 uses load cells to read areas of pressure and microcontrollers to measure the time of pressure to determine when is too long or too much for the pressure. The pressure redistribution system 10 is able to alert an administrator/caregiver through the use of a light display when the pressure is too long or too much and to interact with a pump system connected to air bladders to inflate or deflate accordingly in order to shift the patient into opposite areas of pressure, therefore ensuring the patient is relieved of high pressure areas.

Figure 2:
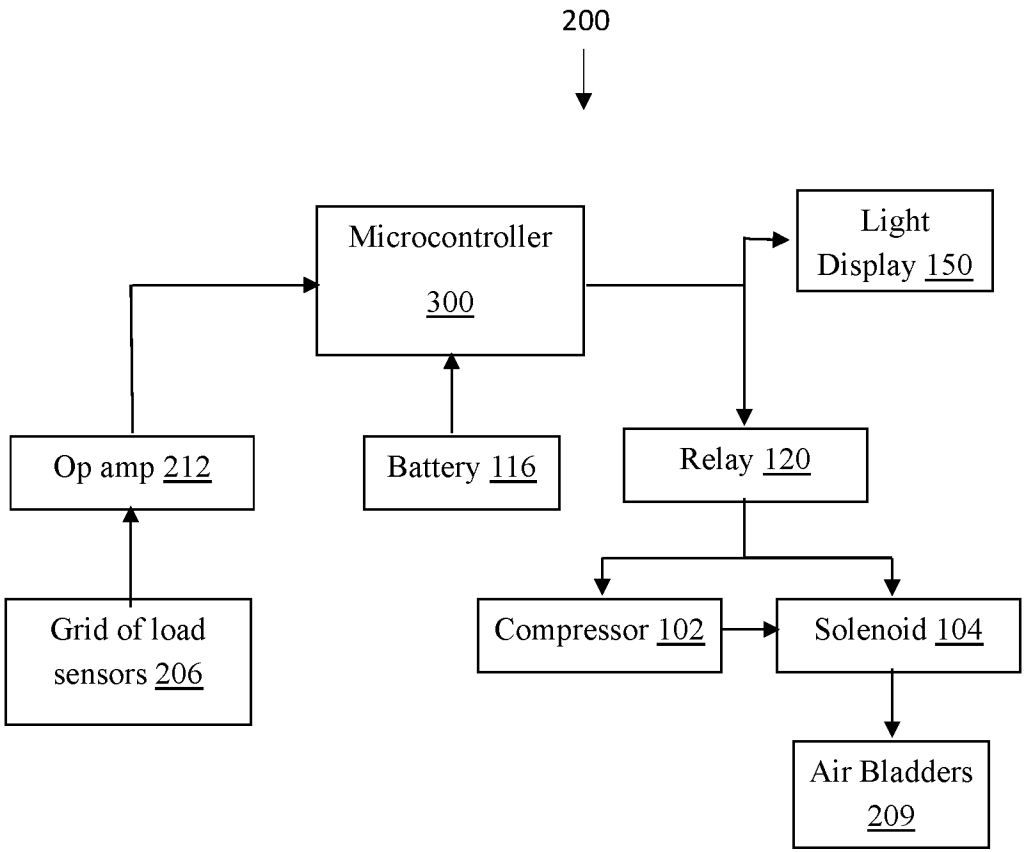
FIG. 2 is a schematic illustration of the pressure redistribution system for use with a wheelchair, according to the present invention.
Figure 3:
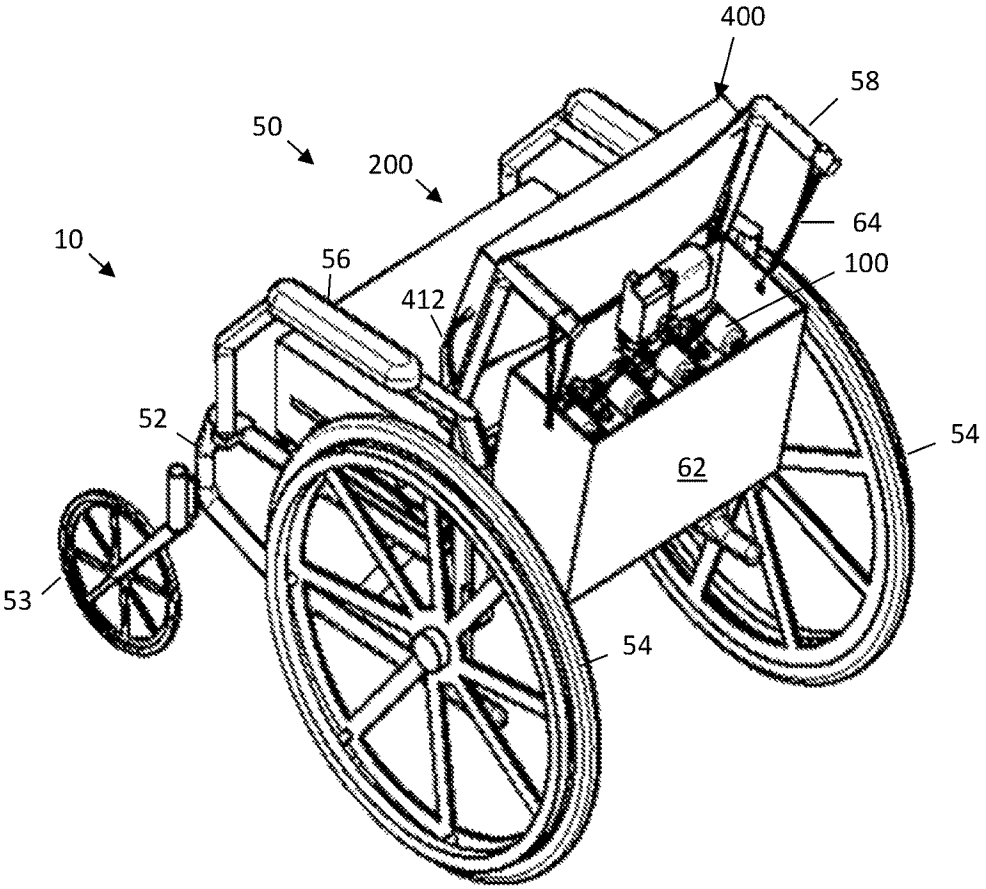
FIG. 3 is a detailed, rear, isometric illustration of the pressure redistribution system for use with a wheelchair, constructed according to the present invention.

As shown in FIGS. 1-3, there is illustrated pressure redistribution system 10 that is constructed according to the present invention. Pressure redistribution system 10 includes, in part, wheelchair assembly 50, pump assembly 100, light display 150, seat cushion sensor system 200, microcontroller 300, and back cushion inflation system 400.

Wheelchair Assembly

As shown more clearly in FIGS. 2 and 3, wheelchair assembly 50 includes in part, wheelchair frame 52, a plurality of rear wheels 54, a plurality of lower handles 56, seat cushion sensor system 200, a plurality of upper handles 58, and back inflation system 400. It is to be understood that except for seat cushion sensor system 200 and back inflation system 400, wheelchair frame 52, the plurality of front wheels 53 and rear wheels 54, the plurality of lower handles 56, the plurality of upper handles 58 are well known in the wheelchair art and will not be described in greater detail. It is to be understood that while a wheelchair assembly 50 is illustrated as being utilized in pressure redistribution system 10, any suitable, stationary chair or reclining chair could also be used in pressure redistribution system 10 and still achieve the same results.

Pump Assembly

With respect to FIGS. 1-4, located adjacent to the back inflation system 400 is pump assembly 100 and light display 150. As shown more clearly in FIG. 4, pump assembly 100, includes, in part, conventional compressor 102, conventional solenoid valves 104, conventional pressure sensor 106, conventional connector 108, conventional threaded fastener 110, conventional adapter 112, conventional threaded connector 114, conventional battery 116 (FIG. 3), and conventional relay 120 (FIG. 2).

As further shown in FIG. 3, pump assembly 100 and light display 150 (FIG. 2) are located adjacent to back inflation system 400. In particular, pump assembly 100 and light display 150 are located within a container 62 which is held on upper wheelchair handles 58 by conventional straps 64. Preferably, container 62 can be constructed of any suitable, durable, rigid, opaque material such as Plexiglas®. However, it is to be understood that container 62 can also be a high-quality tool bag or other similar type of container. The important factor being that container 62 must be able to adequately contain pump assembly 100 and provide access between pump assembly 100 and light display 150. With respect to straps 64, any suitable, durable high strength device can be used as long as the device is capable of adequately retaining container 62 adjacent to back inflation system 400.

With respect to compressor 102, preferably, may be any suitable, durable, and compact onboard 12 volt mini air compressor. However, it is to be understood that the compressor 102 should not produce a great deal of noise, since the noise may not be acceptable to the end user. Also, the compressor 102 must be able to provide a great enough air pressure so as to be able to provide enough air pressure to the air bladders 204 and 404 or other suitable air inflation devices in order to lift up the weight of an average human.

With respect to valves 104, there are preferably at least eight (8) valves 104 and up to sixteen valves 104 which are connected to the plurality of air bladders 204 in the seat cushion sensor system 200 (FIG. 5) and the plurality air bladders 404 in the back inflation system 400 (FIG. 6), as will discussed in greater detail later. Preferably, valves 104 are DC 12V, ¼ inch electric solenoid valves. The important consideration regarding valves 104 is that the valves 104 must be able to be opened and closed in order to provide the proper amount of air to the air bladders 204 and 404 and be able to be properly controlled through the use of a pressure sensor 106.

Regarding pressure sensors 106, the important considerations of the pressure sensors 106 are that the pressure sensors 106 must be able to assist in the determination of which valve 104 in the pump assembly 100 is opened or closed and the length of time for inflation and deflation of the air bladders 204 and 404. Also, it is important that the pressure sensors 106 assist in the continuous measurement of the pressure in each air bladder 204 and 404. In this regard, the pressure sensor 106 must be able to ensure that the air bladders 204 and 404 are not inflated with too much air which may cause the air bladders 204 and/or 404 to exceed their air pressure inflation limit.

Figure 4:
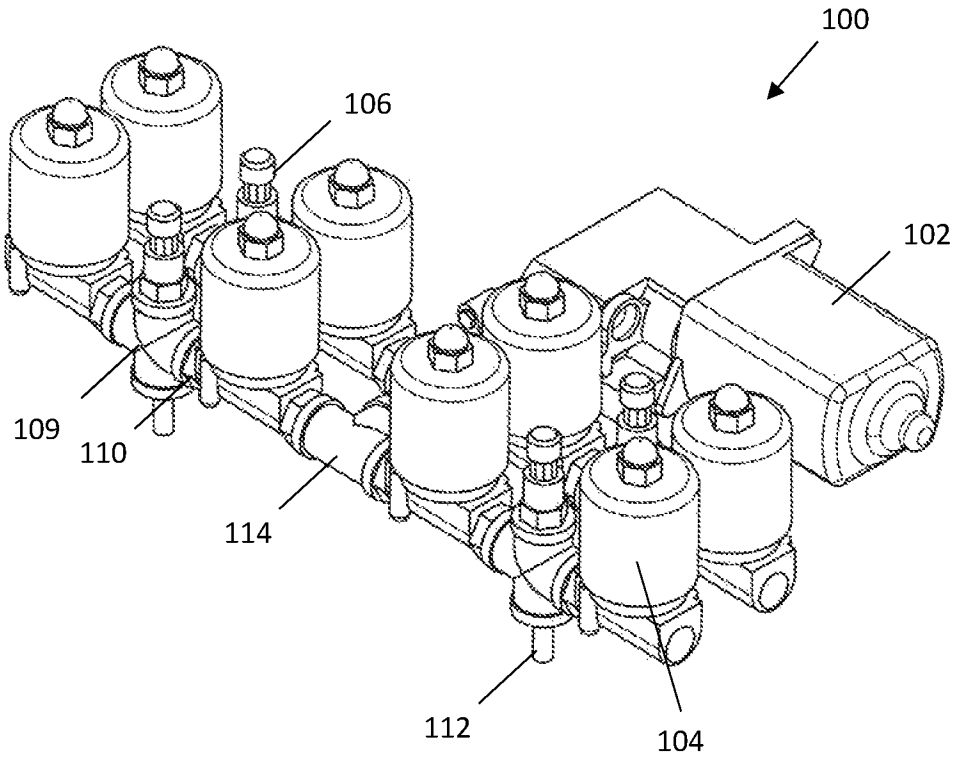
FIG. 4 is an isometric illustration of the pump assembly, constructed according to the present invention.

As shown in FIG. 4, conventional connector 108, conventional threaded fastener 110, conventional adapter 112, and conventional threaded connector 114 are used to connect the valves 104, the pressure sensors 106 and the compressor together so as to construct the unique pump assembly 100.

In order to operate pump assembly 100, light display 150, seat cushion sensor system 200, microcontroller 300, and back inflation system 400, a conventional battery 116 is located within container 62. However, it is to be understood that battery 116 can also be placed at other locations on wheelchair assembly 50. The important consideration being that battery 116 must be able to be easily accessible so that it can be removed/recharged and located nearby pump assembly 100, light display 150 and microcontroller 300. Preferably, battery 116 is a conventional 12 volt, 3.5 amp, rechargeable lead acid battery.

With respect to relay 120 (FIG. 2), relay 120 is used for relaying the information in the microcontroller 300 to the compressor 102 and valves 104. In this manner, the relay 120 is used to provide information to the compressor 102 to turn off and on and to provide information to the valves 104 to open and close.

Light Display

Figure 7:
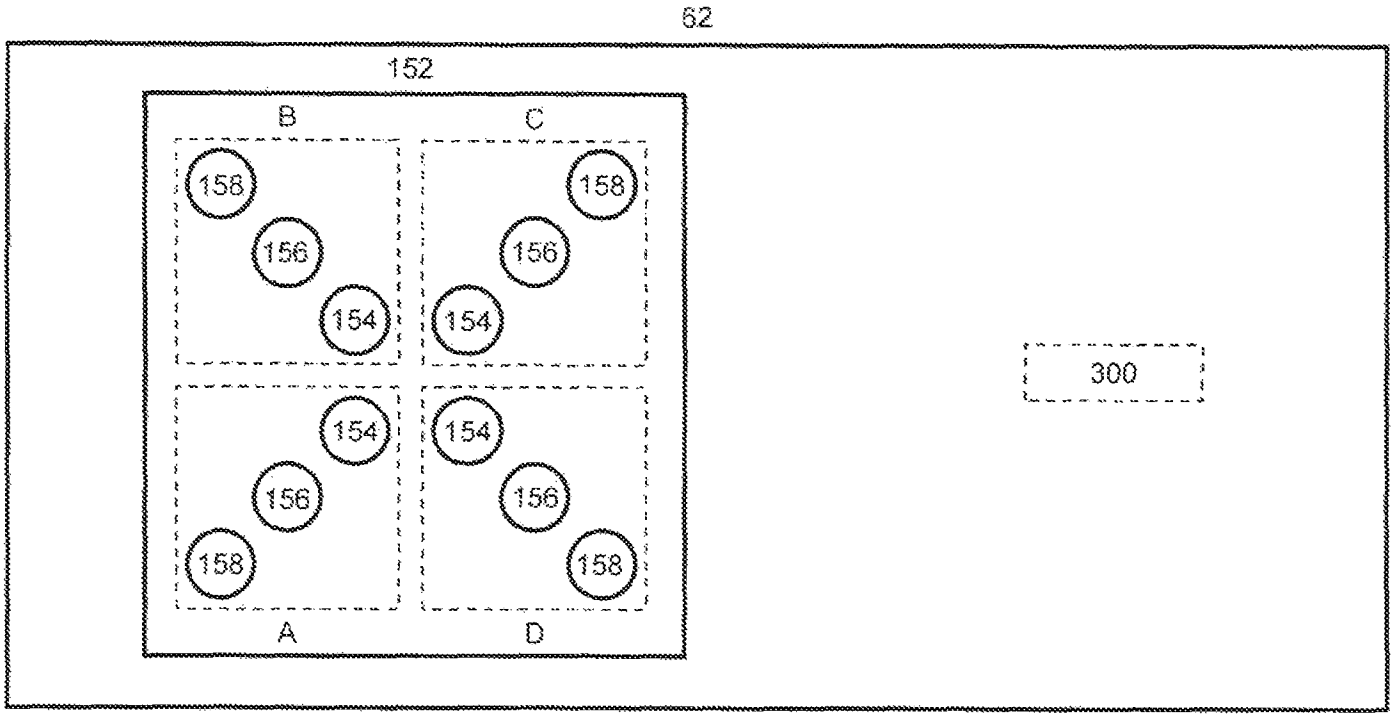
FIG. 7 is a schematic illustration of the light display, constructed according to the present invention.

With respect to FIG. 7, there is illustrated light display 150. Light display 150, preferably, is located on container 62 (FIG. 3). However, it is to be understood that light display 150 can also be located on other locations on wheelchair assembly 50 so long as light display 150 can be readily seen and is located nearby pump assembly 100, seat cushion sensor system 200, and microcontroller 300. As shown in FIG. 7, light assembly 150 includes, in part, light assembly panel 152, and a plurality of lights 154, 156 and 158. Preferably, light assembly panel 152 is any suitable, durable, lightweight panel that is capable of adequately retaining the plurality of lights 154, 156 and 158 that are conventionally attached to light assembly panel 152.

With respect to the plurality of lights 154, 156, and 158, lights 154, 156, and 158, preferably are constructed of conventional light emitting diodes (LEDs). Also, the plurality of lights 154, 156, and 158, preferably are arranged in a traffic light type design to promote a simple but effective visual information device. The plurality of lights 154, 156, and 158 are controlled using the microcontroller 300 in conjunction with the seat cushion sensor system 200 in order to turn on and off at different system states, as will be discussed in greater detail later.

Figure 5:
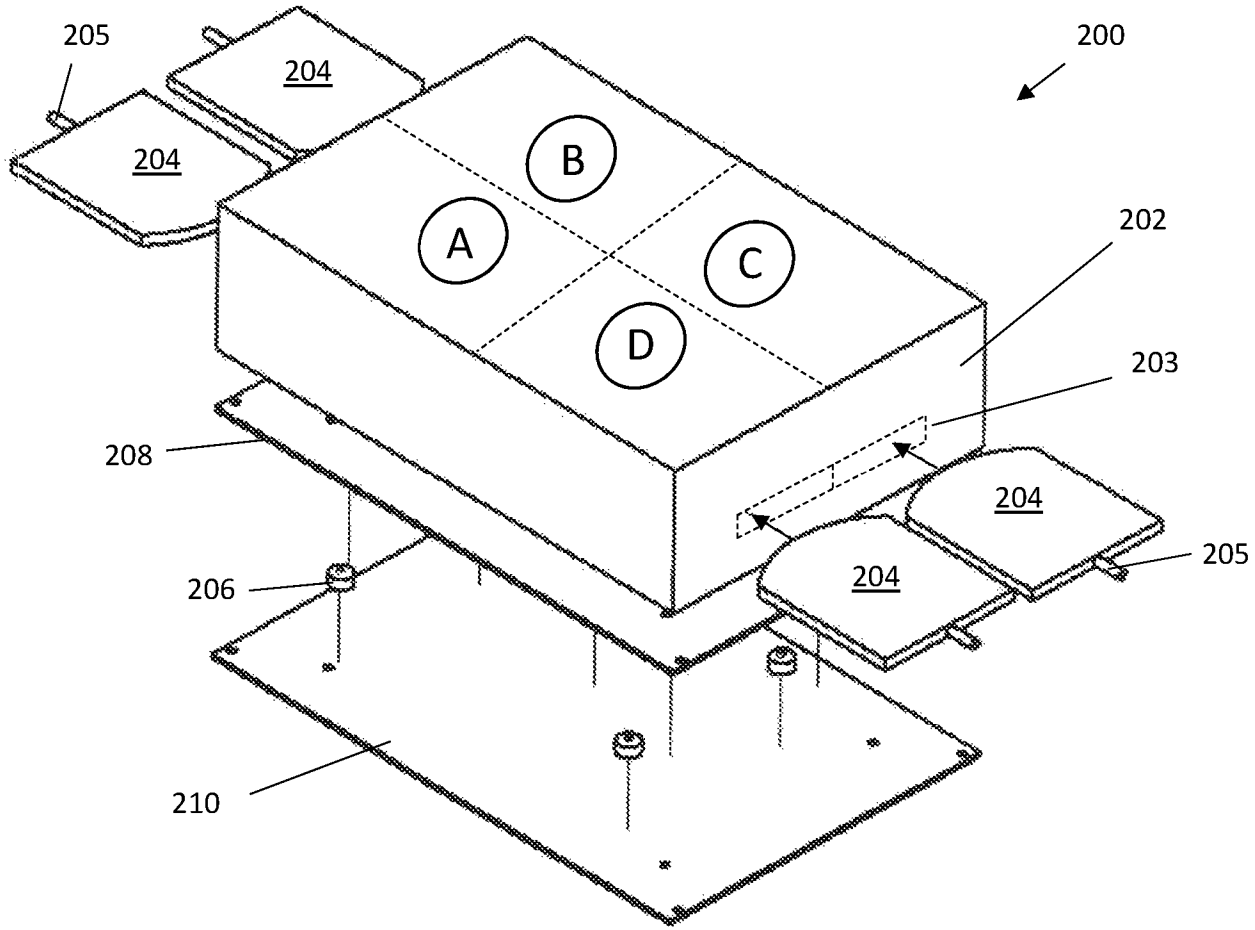
FIG. 5 is an isometric illustration of the sensor system for the seat cushion, constructed according to the present invention.

A unique aspect of the present invention is that lights 154, 156, and 158 are placed on light display 150 in quadrants (A, B, C, and D). These quadrants (A, B, C and D) on light display 150 correspond to the quadrants (A, B, C, and D) in seat cushion sensor system 200 (FIG. 5). In this manner, the lights 154, 156 and 158 in quadrant A, for example, will provide a visual indication as to the load pressure being experienced in quadrant A of seat cushion sensor system 200.

For example, at comparatively low input voltages, the lights 154 in quadrant A of light display 150 would stay solid green, signifying that the force on the load cell in quadrant A of seat cushion sensor system 200 was not high enough to be considered dangerous. If yellow light 156 in quadrant A of light display 150 turns on, this signifies that a high force on quadrant A of seat cushion sensor system 200 is being sensed. If the light 156 starts to blink yellow, this signifies that the static position time limit of the seated patient has been reached. Finally, if red light 158 in quadrant A of light display 150 turns on, this signifies that the load cell in quadrant A of seat cushion sensor system 200 has been high for an unsafe amount of time and the system 10 must adjust the seat cushion sensor system 200 and the back cushion inflation system 400 in order to move the seated patient away from that particular seated position, as will be discussed in greater detail later.

Seat Cushion Sensor System

With reference now to FIG. 5, there is illustrated seat cushion sensor system 200. Seat cushion sensor system 200 includes, in part, cushion 202, cushion opening 203, air bladders 204, air bladder connector 205, load sensors 206, upper seat sensor frame 208, lower sensor frame 210, and conventional operational amplifier 212 (FIG. 2).

With respect to cushion 202, cushion 202, preferably, is constructed of any suitable, durable foam that is capable of retaining the air bladders 204 within opening 203. It is to be understood that opening 203 is constructed within cushion 202 by conventional techniques. Also, opening 203 should be of such a size and shape so as to adequately retain air bladders 204 within cushion 202 but still allow air bladders 204 to properly inflate and deflate.

Regarding air bladders 204, air bladders 204, preferably, are constructed of any suitable, durable material that is easily inflatable and deflatable. However, it is to be understood that air bladders 204 must be relatively small so that one of the air bladders 204 can fit within a quadrant (Quadrants A, B, C and D in FIG. 5) of cushion 202. In this manner, each of the four (4) air bladders 204 illustrated in FIG. 5 is located in each one of the quadrants (Quadrants A, B, C and D). Finally, air bladders 204 must be able to hold the weight of a very heavy object such as a car and not deflate or burst under large amounts of pressure.

As shown in FIGS. 3 and 5, pump assembly 100 is connected to seat cushion sensor system 200 though air bladder connecter 205 by conventional air hoses 212. In this manner, pump assembly 100 is connected to each of the four (4) air hose 212 so that pump assembly 100 can provide the air to each of the air bladders 204 and assist in the monitoring of the air pressure in each of the air bladders 204.

Located below cushion 202 are upper seat cushion frame 208 and lower seat cushion frame 210. Upper seat cushion frame 208 and lower seat cushion frame 210, preferably, are constructed of any suitable, durable material such as aluminum. It is to be understood that upper seat cushion frame 208 and lower seat cushion frame 210 should be of such a size and shape so as to provide adequate support for cushion 202. However, upper seat cushion frame 208 and lower seat cushion frame 210 should also be constructed so as to allow any forces exerted upon upper seat cushion frame 208 to be measured by load sensors 206 and to prevent discomfort when the patient is seated over the load sensors 206.

With respect to load sensors 206, load sensors 206, preferably, are conventional load sensors that are capable of operating at an input of 8 to 12 volts and an output of 0 to 5 volts. Also, load sensors 206 should be able to adequately detect a wide range of loads and loads that are continuously applied over long periods of time.

Regarding operational amplifier 212 (FIG. 2), it was determined by the inventors that the voltage change provided by the load sensors 206 after applying pressure was usually too small for the microcontroller 300 to detect accurate changes in the load sensors 206 without amplification. Therefore, operational amplifiers 212 were utilized to amplify the difference between the two signals of the Wheatstone bridge that made up the circuitry of the load sensor 206 in order to allow microcontroller 300 to more accurately determine the load on each load sensor 206.

Microcontroller

As shown in FIGS. 1-3, pressure redistribution system 10 includes a microcontroller 300. Microcontroller 300, preferably, is a conventional microcontroller that is capable of quantizing the amount of pressure being read by each load cell 206 (FIG. 5) and to be able to convert the analog signal from the load sensor 206 to a digital signal. In particular, the microcontroller 300 must be able to make the determination on whether the patient has changed position or not. Furthermore, the microcontroller 300 must be able to determine if the patient was in a high-pressure position for too long or if they moved to a new position that could be considered permanent. This is a key aspect of the present invention in that the microcontroller 300 must be able to make determinations on what the light display 150 needs to convey to the user or administrator/care giver.

Back Cushion Inflation System

Figure 6:
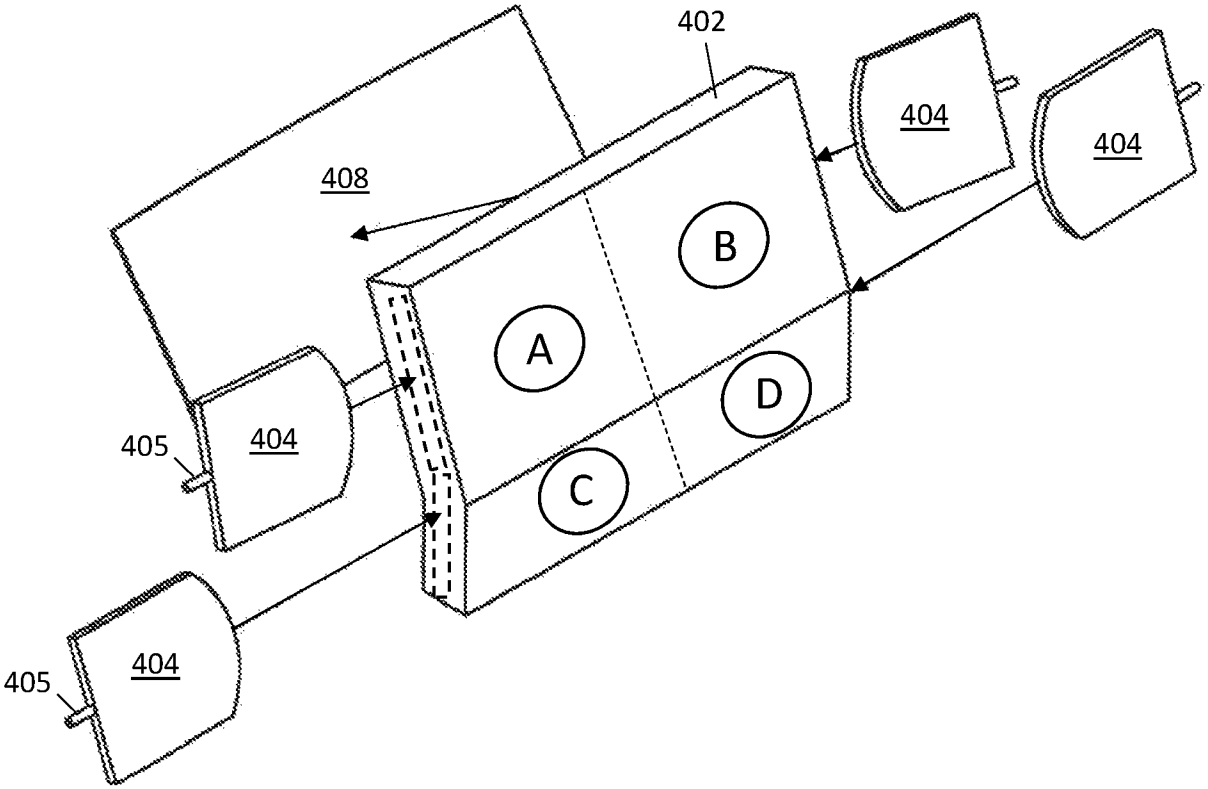
FIG. 6 is an isometric illustration of the inflation system for the back cushion, constructed according to the present invention.

With reference now to FIG. 6, there is illustrated back cushion inflation system 400. Back cushion inflation system 400 includes, in part, cushion 402, cushion opening 403, air bladders 404, air bladder connector 405, and back cushion frame 408.

With respect to cushion 402, cushion 402, preferably, is constructed of any suitable, durable foam that is capable of retaining the air bladders 404 within opening 403. It is to be understood that opening 403 is constructed within cushion 402 by conventional techniques. Also, opening 403 should be of such a size and shape so as to adequately retain air bladders 404 within cushion 402 but still allow air bladders 404 to properly inflate and deflate.

Regarding air bladders 404, air bladders 404, preferably, are constructed of any suitable, durable material that is easily inflatable and deflatable. However, it is to be understood that air bladders 404 must be relatively small so that one of the air bladders 404 can fit within a quadrant (Quadrants A, B, C and D in FIG. 6) of cushion 402. In this manner, each of the four (4) air bladders 404 illustrated in FIG. 6 is located in each one of the quadrants (Quadrants A, B, C and D). Finally, air bladders 404 must be able to hold the weight of a very heavy object such as a car and not deflate or burst under large amounts of pressure.

As shown in FIGS. 3 and 6, pump assembly 100 is connected to back cushion inflation system 400 though air bladder connecter 405 by conventional air hoses 412. In this manner, pump assembly 100 is connected to each of the four (4) air hose 412 so that pump assembly 100 can provide the air to each of the air bladders 404 and assist in the monitoring of the air pressure in each of the air bladders 404.

Located behind cushion 402 is back cushion frame 408. Back cushion frame 208, preferably, are constructed of any suitable, durable material such as aluminum. It is to be understood that back cushion frame 408 should be of such a size and shape so as to provide adequate support for cushion 402. However, back cushion frame 408 should also be constructed so as to prevent discomfort through the act of leaning against back cushion frame 408.

Operation of Pressure Redistribution System

With respect to FIGS. 1-7, the operation and use of the pressure redistribution system 10 will now be discussed. As discussed earner, each of the four (4) air bladders 204 and 404 are located within a quadrant (A, B, C, and D) of seat cushion 202 and back cushion 404, respectively. A load sensor 206 is located beneath each of the air bladders 204 in order to measure the load at each of the quadrants in seat cushion sensor system 200. The pump assembly 100 is operatively connected to each of the air bladders 204 and 404. Each of the load sensors 206 is operatively connected to the microcontroller 300. The light display 150 is operatively connected to the microcontroller 300 and the seat cushion sensor system 200.

Once a patient has seated himself/herself onto cushion 202, the load sensors 206 begin measuring a load of the patient at each of the quadrants (A, B, C, and D) in seat cushion sensor system 200. The microcontroller 300 begins to keep track of the time that the patient has remained in a particular seated position without moving or otherwise shifting to another position. In this manner, the microcontroller 300 and the load sensors 206 keep track of how long a patient has maintained a particular constant load on a particular quadrant in seat cushion sensor system 200.

At this point, the light display 150 should display all green lights 154 in all of the quadrants of light display 150 since the patient has just become seated on the seat cushion sensor system 200. However, if based upon a predetermined amount of time, the load at a particular quadrant of the seat cushion sensor system 200 remains the same, it is assumed that the patient has not moved and the yellow light 156 for that particular quadrant in the seat cushion sensor system 200 is lit. For example, if it is detected that the load in quadrant A in seat cushion sensor system 200 has remained constant for over 10 minutes, yellow light 156 (FIG. 7) in quadrant A of light display 150 will become lit. This signifies that the patient is experiencing a high-pressure area in quadrant A of seat cushion sensor system 200.

If the load in that quadrant of seat cushion sensor system 200 remains high for a further predetermined time limit, the solid yellow light 156 in that corresponding quadrant of light display 150 would then shift to a blinking yellow state. This is intended to act as a warning to administrators that the user had not moved for a still longer given amount of time. For example, if it is detected that the load in quadrant A of seat cushion sensor system 200 has remained constant for over an additional 5 minutes, light 156 in quadrant A (FIG. 7) of light display 150 will now start blinking yellow. At this point, the patient administrator or care giver should consider using pressure redistribution system 10 to re-position the patient by inflating and/or deflating air bladders 204 and 404.

If the load in that quadrant of seat cushion sensor system 200 remains high for an even further predetermined time, the red light 158 in display 150 (FIG. 7) will then become lit. This acts as a visual aid to administrators that the patient needs to be repositioned immediately in order to avoid the danger of developing pressure ulcers. This is also intended to be used as an indicator for the microcontroller 300 to reposition the user through the automated use of seat cushion sensor system 200 and back cushion inflation system 400. For example, if it is detected that the load in quadrant A of seat cushion sensor system 200 has remained constant for over another additional 5 minutes, light 158 in quadrant A of light display 150 (FIG. 6) will be lit in a red color.

Another unique aspect of the present invention is that if light 158 of display 150 is lit in red color and the administrator or other medical personnel who are on hand to assist the patient do not immediately adjust the positon of the patient, microcontroller 300 will conventionally send an electrical signal to pump assembly 100 to inflate/deflate the air bladders 204 and 404 in order to properly reposition the patient.

For example, if light 158 in quadrant A of light display 150 becomes lit in the color red, this means that the patient has been sitting on or applying pressure to quadrant A of seat cushion sensor system 200 for too long of a period of time and could possibly begin to develop pressure ulcers on that part of the patient's body that is located in quadrant A of seat cushion sensor system 200. In this example, the care giver may activate pressure redistribution system 10 so as to reduce the pressure (and load) being experienced at quadrant A of seat cushion sensor system 200. This can be accomplished by inflating or deflating air bladders 204 in seat cushion sensor system 200 and air bladders 404 in back cushion inflation system 400. The important consideration is that the air bladders 204 and 404 are adjusted so that the bad pressure being exerted on quadrant A is alleviated.

It is to be further understood that if the care giver does not respond to the visual notification from light display 150 that the position of the patient needs to changed, the pressure redistribution system 10 will then automatically adjust the air pressure in air bladders 204 and/or 404 so that the load pressure being exerted on quadrant A is alleviated, as discussed above.

It is further to be understood that instead of using light display 150, an electronic device such as a smartphone, tablet, laptop or similar device that is capable of being connected to the Internet could be used. In this manner, the microcontroller 300 relays the information about the information on the bad pressures being experienced at the various quadrants A-D on seat cushion sensor system 200. For example, a virtual light display (not shown) could be displayed on the electronic device (not shown) of the administrator/caregiver so that the virtual light display could provide the administrator/caregiver the same information (in the same manner) as light display 150 provides to the user of pressure redistribution system 10.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in the exact wording in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein are a new and improved pressure redistribution system and method of using the same. The preferred pressure redistribution system, according to various embodiments of the present invention, offers the following advantages: ease of use; lightness in weight; durability; excellent pressure relief characteristics; automatic pressure relief; reduced likelihood of development of pressure ulcers; quietness of operation; ease of measurement of load pressures; use of a visual indication of an undesirable pressure load; and ease of application to a wheelchair. In fact, in many of the preferred embodiments, these advantages of ease of use, lightness in weight, durability, excellent pressure relief characteristics, automatic pressure relief, reduced likelihood of development of pressure ulcers, quietness of operation, ease of measurement of load pressures, use of a visual indication of an undesirable pressure load, and ease of application to a chair or wheelchair are optimized to an extent that is considerably higher than heretofore achieved in prior, known pressure redistribution systems.

We claim:

1. A pressure redistribution system, comprising:

a chair having a frame;

a back cushion inflation system operatively connected to an upper portion of the frame, wherein the back cushion inflation system includes a back cushion and a plurality of back cushion air bladders located within an opening in the back cushion;

a pump system operatively connected to the back cushion inflation system for inflating and deflating the back cushion air bladders;

a seat cushion sensor system operatively attached to the chair frame and the pump system, wherein the seat cushion sensor system includes a seat cushion and a plurality of seat cushion air bladders located within an opening in the seat cushion and a plurality of load sensors located adjacent to the plurality of seat cushion air bladders and wherein the pump system is able to inflate and deflate the plurality of seat cushion air bladders;

a light display operatively connected to the back cushion inflation system, wherein the light display provides a visual indication as to a pressure being experienced by each of the plurality of load sensors; and a microcontroller located adjacent to the pump system, the seat cushion sensor system and the light display to assist in a determination of the pressure being experienced by each of the plurality of load sensors and to assist in providing the visual indication as to a pressure being experienced by each of the plurality of load sensors.

2. The pressure redistribution system, according to claim 1, wherein the back cushion inflation system is further comprised of:

a back cushion frame having a first side and a second side such that the back cushion is operatively connected to the first side of the back cushion frame and the pump system and the light display are operatively connected to the second side of the back cushion frame.

3. The pressure redistribution system, according to claim 1, wherein each of the back cushion air bladders is further comprised of:

a back cushion air bladder connector that operatively connects each of the back cushion air bladders to the pump system.

4. The pressure redistribution system, according to claim 1, wherein the pump system is further comprised of:

an air compressor;

a plurality of valves operatively connected to the air compressor; and a plurality of air pressure sensors operatively connected to the plurality of valves and the microcontroller.

5. The pressure redistribution system, according to claim 1, wherein the seat cushion sensor system is further comprised of:

an upper seat sensor frame having a first side and a second side such that the seat cushion is operatively attached to the first side of the upper seat sensor frame; and a lower sensor frame, wherein the plurality of load sensors is located between the second side of the upper seat cushion frame and the lower seat cushion frame.

6. The pressure redistribution system, according to claim 1, wherein each of the seat cushion air bladders is further comprised of:

a seat cushion air bladder connector that operatively connects each of the seat cushion air bladders to the pump system.

7. The pressure redistribution system, according to claim 1, wherein the light display is further comprised of:

a light display panel operatively connected to the back cushion inflation system; and a plurality of lights operatively connected to the light display panel, wherein the plurality of lights is used to provide the visual indication as to a pressure being experienced by each of the plurality of load sensors.

8. The pressure redistribution system, according to claim 7, wherein the plurality of lights is further comprised of:

a plurality of green lights;

a plurality of yellow lights; and a plurality of red lights.

9. A wheelchair having a pressure redistribution system, comprising:

a wheelchair having a frame;

a back cushion inflation system operatively connected to an upper portion of the frame, wherein the back cushion inflation system includes a back cushion and a plurality of back cushion air bladders located within an opening in the back cushion;

a pump system operatively connected to the back cushion inflation system for inflating and deflating the back cushion air bladders;

a seat cushion sensor system operatively attached to the wheelchair frame and the pump system, wherein the seat cushion sensor system includes a seat cushion and a plurality of seat cushion air bladders located within an opening in the seat cushion and a plurality of load sensors located adjacent to the plurality of seat cushion air bladders and wherein the pump system is able to inflate and deflate the plurality of seat cushion air bladders;

a light display operatively connected to the back cushion inflation system, wherein the light display provides a visual indication as to a pressure being experienced by each of the plurality of load sensors; and a microcontroller located adjacent to the pump system, the seat cushion sensor system and the light display to assist in a determination of the pressure being experienced by each of the plurality of load sensors and to assist in providing the visual indication as to a pressure being experienced by each of the plurality of load sensors.

10. The wheelchair, according to claim 9, wherein the back cushion inflation system is further comprised of:

a back cushion frame having a first side and a second side such that the back cushion is operatively connected to the first side of the back cushion frame and the pump system and the light display are operatively connected to the second side of the back cushion frame.

11. The wheelchair, according to claim 9, wherein each of the back cushion air bladders is further comprised of:

a back cushion air bladder connector that operatively connects each of the back cushion air bladders to the pump system.

12. The wheelchair, according to claim 9, wherein the pump system is further comprised of:

an air compressor;

a plurality of valves operatively connected to the air compressor; and a plurality of air pressure sensors operatively connected to the plurality of valves and the microcontroller.

13. The wheelchair, according to claim 9, wherein the seat cushion sensor system is further comprised of:

an upper seat sensor frame having a first side and a second side such that the seat cushion is operatively attached to the first side of the upper seat sensor frame; and a lower sensor frame, wherein the plurality of load sensors is located between the second side of the upper seat cushion frame and the lower seat cushion frame.

14. The wheelchair, according to claim 9, wherein each of the seat cushion air bladders is further comprised of:

a seat cushion air bladder connector that operatively connects each of the seat cushion air bladders to the pump system.

15. The wheelchair, according to claim 9, wherein the light display is further comprised of:

a light display panel operatively connected to the back cushion inflation system; and a plurality of lights operatively connected to the light display panel, wherein the plurality of lights is used to provide the visual indication as to a pressure being experienced by each of the plurality of load sensors.

16. The wheelchair, according to claim 15, wherein the plurality of lights is further comprised of:

a plurality of green lights;

a plurality of yellow lights; and a plurality of red lights.

17. A method of providing a wheelchair with a pressure redistribution system, comprising the steps of:

providing a wheelchair having a frame;

providing a back cushion inflation system, wherein the back cushion inflation is operatively connected to an upper portion of the frame, wherein the back cushion inflation system includes a back cushion and a plurality of back cushion air bladders located within an opening in the back cushion;

providing a pump system, wherein the pump system is operatively connected to the back cushion inflation system for inflating and deflating the back cushion air bladders;

providing a seat cushion sensor system, wherein the seat cushion sensor system is operatively connected to the wheelchair frame and the pump system, wherein the seat cushion sensor system includes a seat cushion and a plurality of seat cushion air bladders located within an opening in the seat cushion and a plurality of load sensors located adjacent to the plurality of seat cushion air bladders and wherein the pump system is able to inflate and deflate the plurality of seat cushion air bladders;

providing a light display, wherein the light display is operatively connected to the back cushion inflation system, wherein the light display provides a visual indication as to a pressure being experienced by each of the plurality of load sensors; and providing a microcontroller, wherein the microcontroller is located adjacent to the pump system, the seat cushion sensor system and the light display to assist in a determination the pressure being experienced by each of the plurality of load sensors and to assist in providing the visual indication as to a pressure being experienced by each of the plurality of load sensors.

18. The method of providing a wheelchair with a pressure redistribution system, according to claim 17, wherein the method is further comprised of the step of:

using the load sensors and the microcontroller to determine if a patient has been seated in a particular seated position for a pre-determined period of time.

19. The method of providing a wheelchair with a pressure redistribution system, according to claim 18, wherein the method is further comprised of the step of:

providing the light display with a plurality of lights, wherein the plurality of lights is used to provide the visual indication as to how long the patient has been seated in the particular seated position and if the patient has been seated in the particular seated position for the pre-determined period of time.

20. The method of providing a wheelchair with a pressure redistribution system, according to claim 18, wherein the method is further comprised of the step of:

adjusting an air pressure in the back cushion air bladders and the seat cushion air bladders after the pre-determined period of time has been reached.

* * * * *